United States Patent [19]

Bell et al.

[11] 4,031,829

[45] June 28, 1977

[54] CONVEYOR SYSTEM

[75] Inventors: Edward L. Bell, St. Clair Shores; Ivan L. Ross, Birmingham, both of Mich.

[73] Assignee: American Chain & Cable Company, Inc., Bridgeport, Conn.

[22] Filed: June 2, 1975

[21] Appl. No.: 582,844

[52] U.S. Cl. ..... 104/172 S; 104/172 C

[51] Int. Cl.[2] ..... B61B 12/02; B61J 3/00

[58] Field of Search ..... 104/96, 172 R, 172 S, 104/172 C; 198/177 R, 177 T, 78; 104/88, 89

[56] References Cited

UNITED STATES PATENTS

| | | | |
|---|---|---|---|
| 3,741,126 | 6/1973 | Ross | 104/172 S |
| 3,915,287 | 10/1975 | Seymour et al. | 104/172 S |

*Primary Examiner*—L. J. Paperner
*Assistant Examiner*—Carl Rowold
*Attorney, Agent, or Firm*—Barnes, Kisselle, Raisch & Choate

[57] ABSTRACT

A conveyor system including a first load supporting track and a second load supporting track with an intermediate transfer portion. A powered conveyor is provided in association with each of the first and second tracks. A plurality of carriers are provided. Each of the carriers has a first dog that is in position for normal engagement with the pusher member of the conveyor and longitudinally spaced second and third dogs that are normally urged to an operative carrier pushing position but are held by the track out of operative position. The second and third dogs include cam projections thereon that engage portions of the track which hold the second and third dogs out of operative position. The cam projection on the second dog extends oppositely to the cam projection on the third dog. At a transfer point, an appropriate portion of the track is cut away to permit either the second or third dogs to move to operative carrier transferring position.

5 Claims, 12 Drawing Figures

CONVEYOR SYSTEM

This invention relates to conveyor systems and particularly to power and free conveyor systems.

BACKGROUND OF THE INVENTION

In power and free conveyor systems wherein carriers are moved along predetermined paths by engagement with conveyors, it is often necessary to transfer the carriers from one predetermined path to another. In one type of system, this transfer is achieved by providing a transfer conveyor that engages the carrier and transfers it between the predetermined paths. In another type of system, the carrier is moved from one path toward the other and then pushed through the transfer area to the second path.

The invention is also applicable to the transfer of a carrier from one powered conveyor to another, either from a faster to a slower conveyor or from a slower conveyor to a faster conveyor or between conveyors moving at the same speed.

In U.S. Pat. Nos. 3,640,226, and 3,662,873, there is shown a power and free conveyor system wherein each of the carriers has a second dog that is normally urged to operative carrier position but is held by the track out of operative position. At a transfer point, a portion of the track is cut away to permit the second dog to move to operative carrier transferring position. Such a system effectively provides for transfer of the carrier without any change in elevation of the power and free tracks. However, where the pushers on the conveyor chain are spaced apart greater distances or where the system includes transfer across short and long distances, a loss of efficiency in transfer may occur either because of the time delay in awaiting a pusher on the conveyor chain or minimum length between the first and second dogs.

It has also been heretofore suggested to provide a third dog on the carrier which has the same configuration as the second dog and is normally held out of operative position by the track but can be brought to operative position to transfer the carrier across a greater distance.

Among the objects of the present invention are to provide a power and free conveyor system wherein a carrier is transferred from one predetermined path to another by pushing across a transfer zone in a minimum period of time and wherein such system is achieved with minimum cost and maintenance; and wherein selective transfer of the carrier can be achieved over short and long distances as desired.

SUMMARY OF THE INVENTION

In accordance with the invention, a third dog is provided in longitudinally spaced relation to the first and second dogs and is normally urged to an operative carrier pushing position but is held by the track out of operative position. The second and third dogs include cam projections thereon that engage portions of the track which hold the second and third dogs out of operative position. The cam projection on the second dog extends oppositely to the cam projection on the third dog. As the carrier moves to a transfer zone one or the other of the second and third dogs is successively moved to operative position. By providing selectively operable second and third dogs, it is possible to transfer across short or long distances thereby accommodating various systems wherein the transfer varies between short and long distances.

DESCRIPTION

Figure 1:
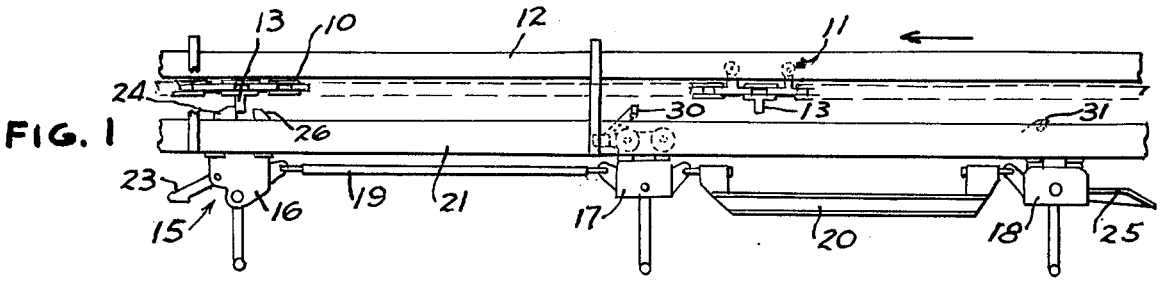
FIG. 1 is a fragmentary side elevational view of a conveyor system embodying the invention.
Figure 3:
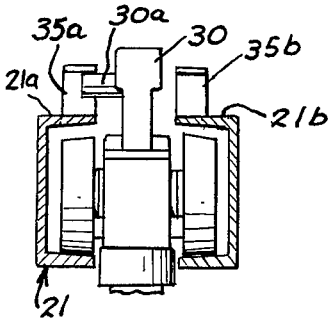
FIG. 3 is a fragmentary sectional view taken along the line 3—3 in FIG. 2.
Figure 6:
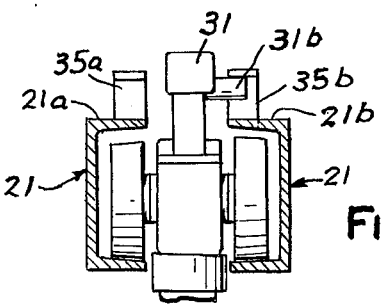
FIG. 6 is a fragmentary sectional view taken along the line 6—6 in FIG. 2.

Referring to FIG. 1, the invention relates to a conveyor system wherein a power chain is adapted to selectively engage trolleys and move them in predetermined paths. The trolley motion is from right to left. Specifically, conveyor chain 10 is supported by chain trolleys 11 for movement along a track 12. The chain 10 includes longitudinally spaced pushers 13 that are adapted to engage carriers, as presently described, to move them. As shown, a carrier 15 may comprise longitudinally spaced trolleys 16, 17, 18 pivotally interconnected by tie bars 19, 20. The trolleys include wheels 22 that engage the lower flanges of spaced inwardly facing C-shaped channels of track 21 (FIG. 3 and 6). The foremost trolley 16 includes an actuating lever 23 that is operatively connected to a pusher dog 24 so that when lever 23 engages an obstacle or a projection 25 on the rear trolley 18 of a preceding carrier, the lever 23 is swung clockwise as viewed in FIG. 1 to lower the pusher dog 24 out of the path of a pusher 13. Such an arrangement is known as an accumulating conveyor system. The foremost trolley 16 further includes a pivoted holdback dog 26 in accordance with conventional practice.

Figure 7:
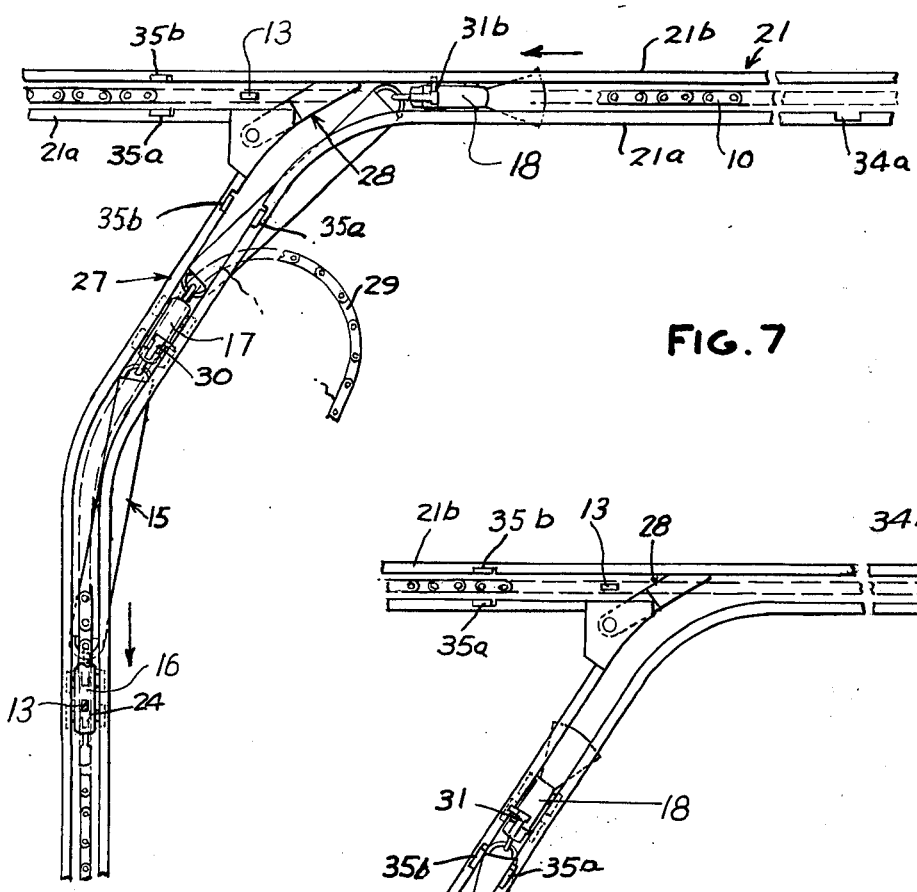
FIG. 7 is a fragmentary plan view of the system.

As further shown in FIG. 7, the conveyor system is shown in connection with an exit switch which includes a second track 27 that extends at an angle from the track 21 and a switch tongue 28 that is operated to selectively guide the carrier 15 into the second track 27. The switch tongue 28 is controlled by signal devices such as are well known in the art, for example, as shown in the U.S. Pat. No. 2,868,139. A second power chain 29 is provided in overlying relation to a portion of the track 27 and is adapted to pick up the carrier and move it along the track 27.

Figure 2:
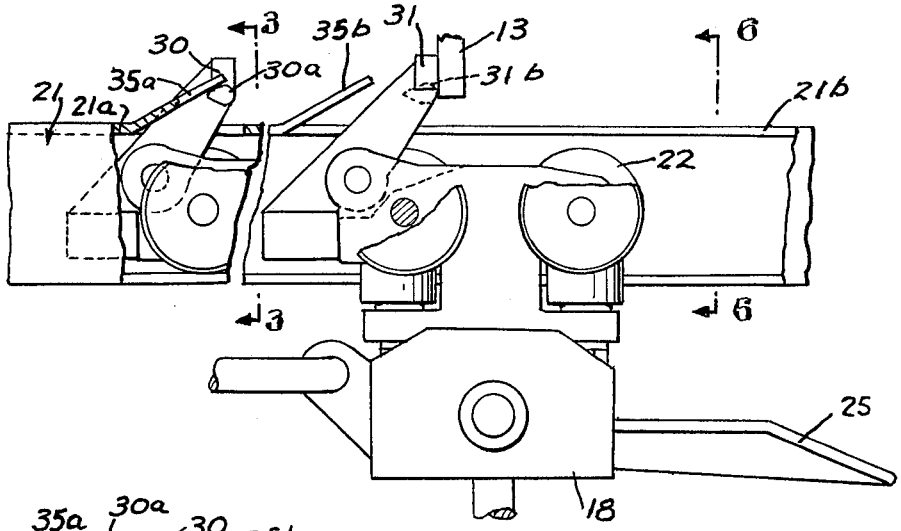
FIG. 2 is a fragmentary elevational view on an enlarged scale of a portion of the system shown in FIG. 1.
Figure 4:
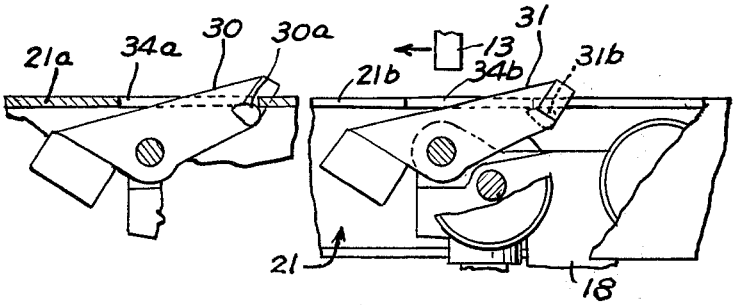
FIG. 4 is a fragmentary side elevational view similar to FIG. 2 showing the parts in a different operative position.
Figure 5:
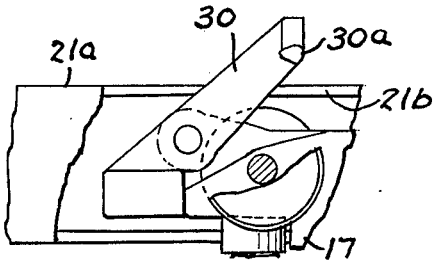
FIG. 5 is a fragmentary view similar to FIGS. 2 and 4 showing the parts in different operative position.

Referring more specifically to FIG. 1, succeeding trolleys 17, 18 of the carrier 15 are each provided with a pivoted pusher dog 30, 31 respectively, each of which is pivoted intermediate to its ends to its respective trolley and counterweighted so that the pusher dog end 30, 31 thereof is urged normally to operative pushing position. However, the width of each pusher dog 30, 31 is such that the top edges of projections 30*a*, 31*b* respectively, normally engage the underside of the upper horizontal flanges 21*a*, 21*b* of the track so that the pusher dogs 30, 31 are normally in the position shown in FIG. 4, namely, out of the path of pushers 13. Projection 31*b* extends beneath the flange 21*b* while projection 30*a* extends in the opposite direction beneath the flange 21*a*. As shown in FIG. 7, in the case of a transfer of the carrier from the track 21 to the track 27 by positioning of the switch tongue 28, a portion of the flange 21*a* is cut away as at 34*a*, to permit the pusher dog to swing counterclockwise under the action of the counterweight to the position shown in FIGS. 2 and 5 and thereby be in position for engagement with a pusher 13 which will push the carrier 15 through the switching or transfer area into position for engagement of the leading power dog 24 with the pusher of a secondary chain 29 along second track 27.

When the switch tongue 28 is actuated to divert the carrier, the pusher 13 which is in engagement with the pusher dog 24 will disengage from the pusher dog 24 as the foremost trolley 16 of carrier 15 is diverted to the track 27. The carrier 15 will then be momentarily stopped. However, by this time, the pusher dog 30 will have been moved upwardly through track opening 34*a* so that the succeeding pusher 13 of the power chain 10 will engage and cause the carrier 15 to be moved further along the track 27 sufficiently to permit dog 24 to be picked up by a pusher of the second power chain 29. As the carrier is moved along track 27, the upper flange 21*a* of track 27 is provided with a cam down opening 35*a* which will engage projection 30*a* of the pusher dog 30 to pivot it down out of the path of the pusher of chain 29. In order to cause downward movement of the pusher dog 30*a*, a portion 35*a* of the flange 21*a* is bent upwardly. Through this transfer, dog 31 is held down by flange 21*b* out of operative position.

Figure 8:
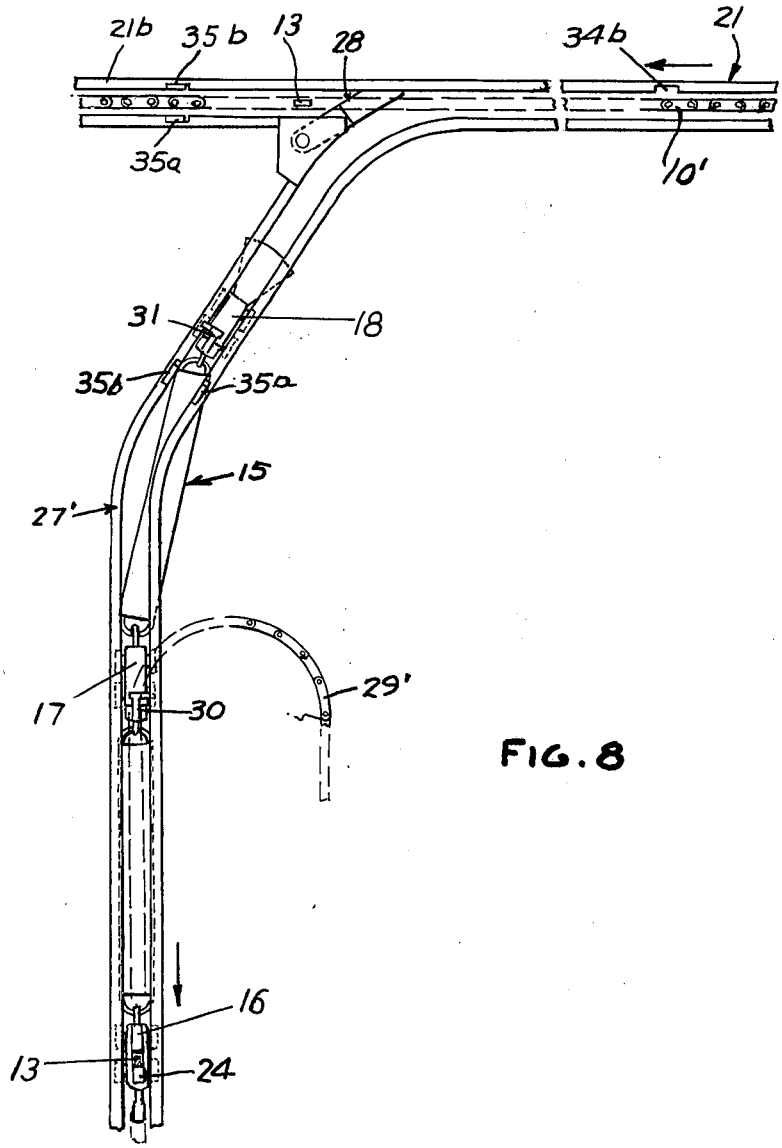
FIG. 8 is a fragmentary plan view of a modified form of conveyor system.

Referring to FIG. 8, there is shown an exit system where the transfer is across a greater gap than in FIG. 7. In FIG. 8 when the switch tongue 28 is actuated to divert the carrier, the pusher 13 which is in engagement with pusher dog 24 will disengage from the pusher dog 24 as the foremost trolley 16 of the carrier 15 is diverted to the track 27′. The carrier 15 will then be momentarily stopped. However, by this time, the pusher dog 31 will have been moved upwardly through track opening 34*b* so that a succeeding pusher 13 of the power chain 10′ will engage pusher dog 31 and cause the carrier 15 to be moved further along the track 27′ sufficiently to permit dog 24 to be picked up by a pusher of the second power chain 29′. As the carrier is moved along track 27′, the upper flange 21*b* of track 27′ is provided with a cam down opening 35*b* which will engage projection 31*a* of the pusher dog 31 to pivot it down out of the path of the pusher of chain 29′. In order to cause downward movement of the pusher dog 31, a portion 35*b* of the flange 21*b* is bent upwardly. Through this transfer dog 30 is held down by flange 21*a* in inoperative position.

More specifically, as shown in FIGS. 7 and 8, the dog 30 can be used for a short distance of transfer (FIG. 7) while dog 31 can be used for a long distance of transfer as when the chain 29′ is a greater distance from chain 10′ (FIG. 8).

Cam down openings 35*a*, 35*b* may normally be both provided, as shown. Although not used to effect transfer to: (1) simplify design and construction; and (2) return dog 30, 31 to inoperative position which may have not been used to effect transfer but was moved to the operative position while passing through the switch area.

It can thus be seen that in accordance with the invention, a third dog is provided in longitudinally spaced relation to the first and second dogs and is normally urged to an operative carrier pushing position but is held by the track out of operative position. As the carrier moves to a transfer zone, one or the other of the second and third dogs is successively moved to operative position. As a result, it is possible to transfer selectively across a greater or shorter distance thereby accommodating various systems wherein the transfer varies between short and long distances.

In both forms of FIGS. 7 and 8, a carrier which is not switched off is pushed all the way through the switching area by engagement of its front dog 24 with a dog 13 of the power chain so that the trailing dogs 30, 31 move through this area without being in contact with a dog 13. As a result, dogs 30, 31 are free to swing upward to their operating position at the start of the track flange cut-outs 34*a*, 34*b* and are forced down again at 35*a*, 35*b*.

Figure 9:
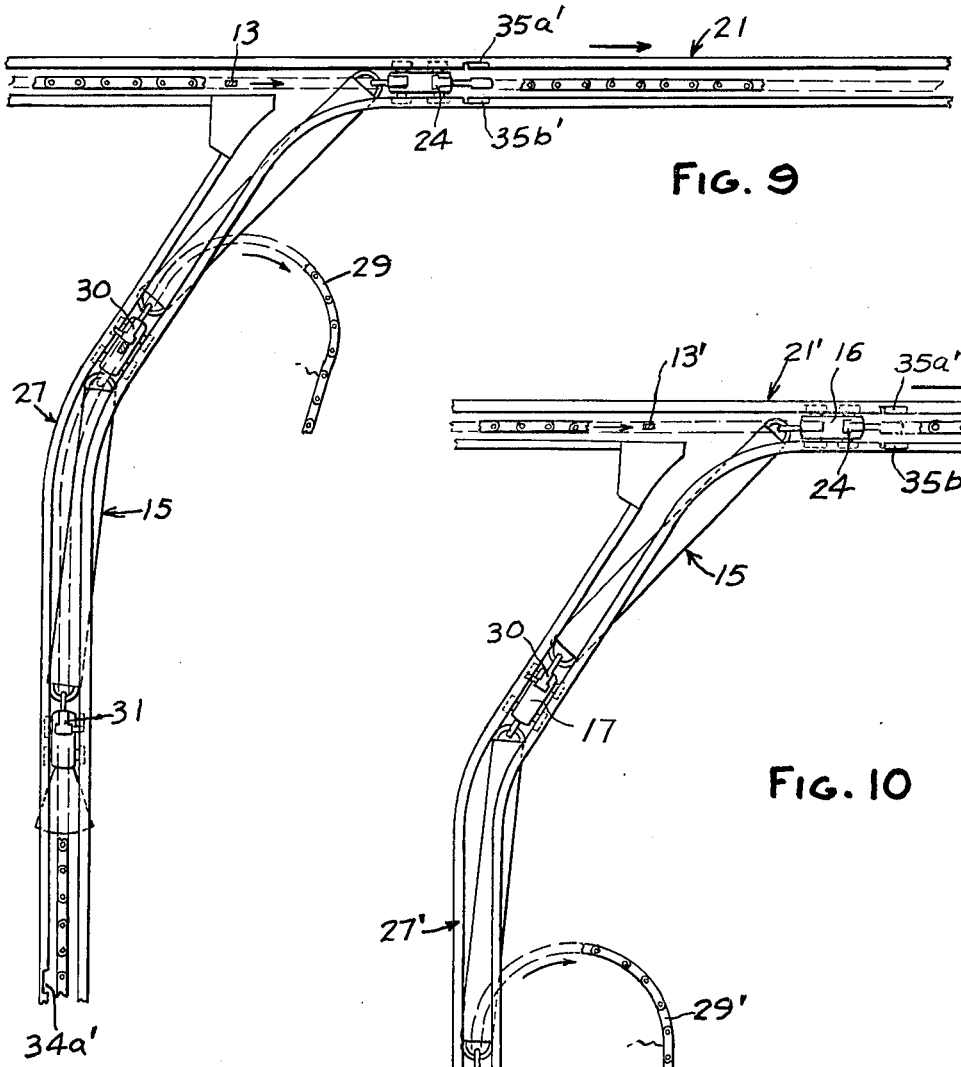
FIG. 9 is a fragmentary plan view of a further modified form of conveyor system.
Figure 10:
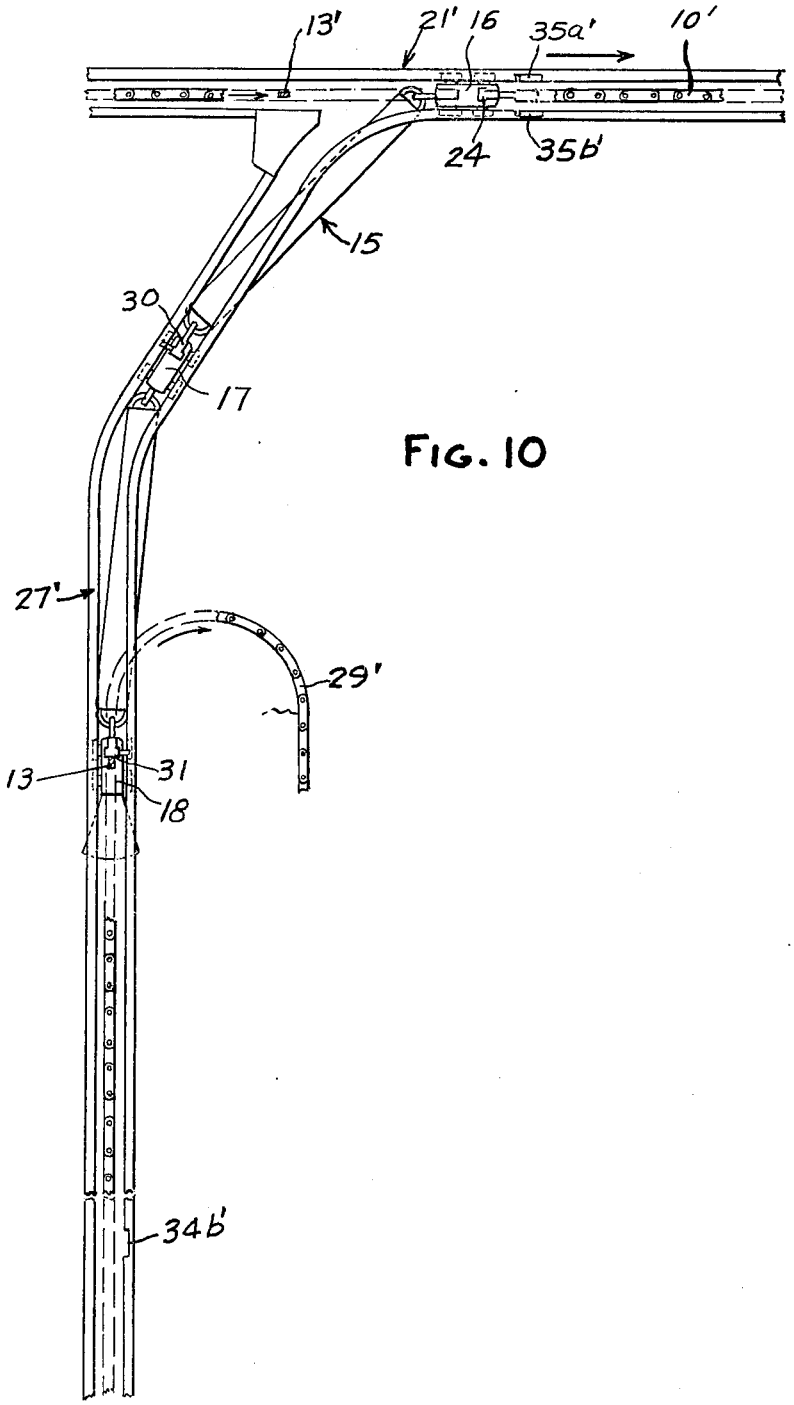
FIG. 10 is a fragmentary plan view of another modified form of conveyor system.

In a track configuration as in FIGS. 7 and 8, but with the carriers and chains moving in the opposite direction as shown in FIGS. 9 and 10, a carrier would move either from left to right on the straight tracks 21 or would enter this track from track 27. No cut-outs 34*a*, 34*b* are needed in tracks 21 in this case, but only in track 27 to move dog 30, 31 to operative position to enable a pusher dog 13 on power chain 29 to advance the carrier far enough to place the front dog 24 into the path of the chain 10 and pusher dogs 13. Cam down openings 35*a*, 35*b* will normally be located on track 21 to return dog 30, 31 to inoperative position after transfer.

More specifically, referring to FIG. 9, wherein the carrier is to be moved across the shorter gap from track 27, the dog 30 is permitted to move upwardly through opening 34*a*′ into the path of a succeeding pusher of chain 29 which will, in turn, push the carrier to bring dog 24 into the path of a pusher on chain 13 moving along track 21. Further movement of the carrier along track 21 will bring the projection on pusher dog 30 into engagement with cam down portion 35*a*′ to pivot dog 30 downwardly.

Similarly, where the gap to be traversed is greater as in FIG. 10, the cut out portion 34*b*′ permits dog 31 to pivot upwardly so that a succeeding pusher on chain 29 will push the carrier to bring its dog 24 into the path of a pusher 13′ on the chain moving along track 21′. As the carrier is moved along track 21′, cam down portion 35*b*′ will pivot dog 31 downwardly.

Throughout the portion of the system wherein the transfer is achieved, the relative positions vertically of the power track 12 and carrier tracks 21, 27 remain constant and are not changed.

Figure 11:
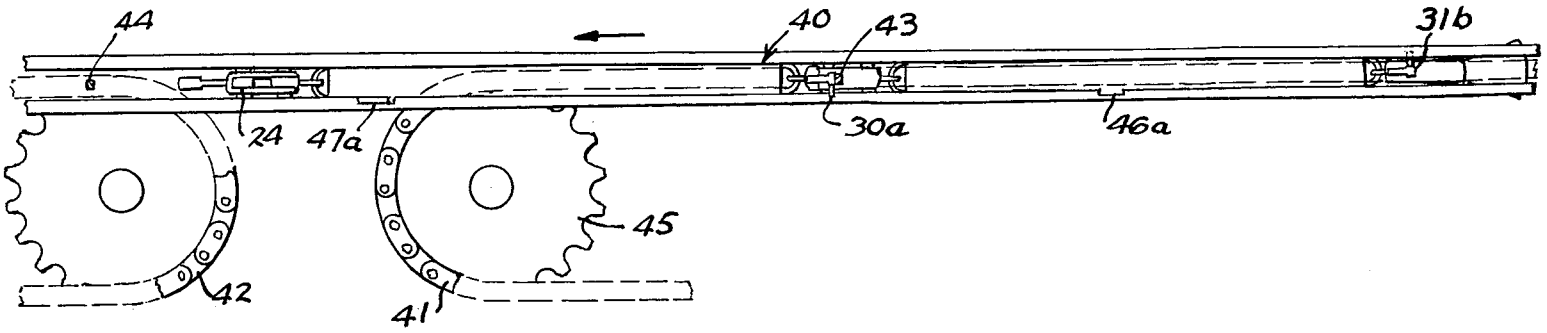
FIG. 11 is a fragmentary plan view of a further modified form of conveyor system.

In another type of system, the carrier is moved from one path toward the other and then is pushed through the transfer area to the second. Specifically, as shown in FIG. 11, the carrier is moved along a track 40 in a portion between spaced power conveyors 41, 42, each of which has pushers 43, 44. As the conveyor 41 moves over its sprocket 45, the pusher 43 thereon which is in engagement with the pusher dog 24 of the carrier will disengage from the pusher dog 24 and will be momentarily stopped. At this point, cut-away portion 46*a*, along the track 40 will have permitted the second pusher dog 30 of the carrier to pivot upwardly into the path of a succeeding pusher 43 which then pushes the carrier across the gap between the conveyors 41, 42 bringing the leading pusher dog 24 into a position of engagement with a pusher dog 44 of the succeeding conveyor 42. As the carrier is pulled across the space by pusher 44 between the conveyors 41, 42, the cam projection 30*a* on the second pusher dog 30 engages the cam down portion 47*a* which pivots dog 30 downwardly returning it to an inoperative position.

Figure 12:
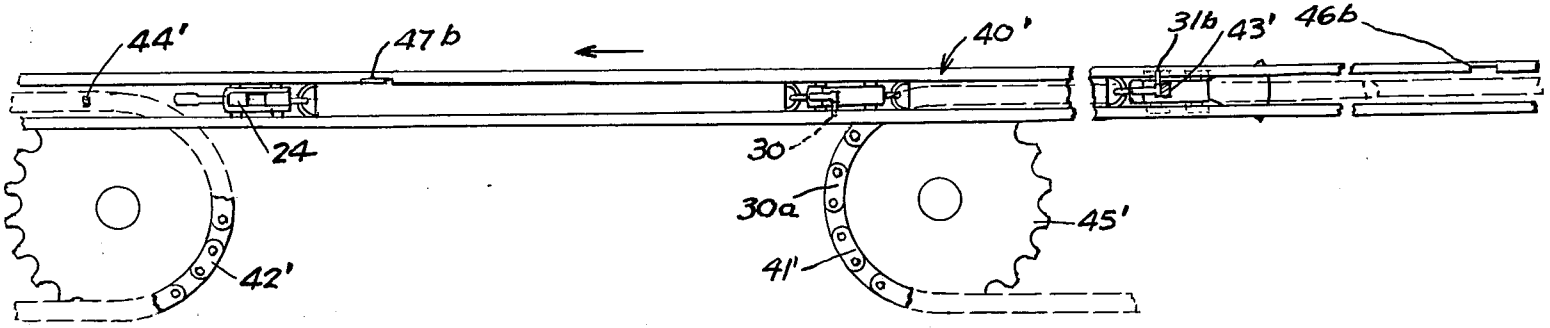
FIG. 12 is a fragmentary plan view of a further modified form of conveyor system.

A greater gap to be traversed than FIG. 11, is shown in FIG. 12. This arrangement is such that the third dog 31 is permitted to pivot upwardly. Specifically, the carrier is adapted to move along a track 40' in a portion between spaced power conveyors 41', 42', each of which has pushers 43', 44'. As the conveyor 41' moves over its sprocket 45', the pusher 43' thereon which is in engagement with the pusher dog 24 of the carrier will disengage from the pusher dog 24 and will be momentarily stopped. At this point, cut-away portion 46*b* along the track 40' will have permitted third pusher dog 31 of the carrier to pivot upwardly into the path of a succeeding pusher 43' which then pushes the carrier across the gap between the conveyors 41', 42' bringing the leading pusher dog 24 into a position of engagement with a pusher 44' of the succeeding conveyor 42'. As the carrier is pulled across the space by pusher 44' between the conveyors 41', 42', the cam projection 31*b* on the third pusher dog 31 engages the cam down portion 47*b* which pivots dog 31 downwardly returning it to an inoperative position.

Thus, the dog 30 can be used to transfer across a short distance (FIG. 11) and the dog 31 can be used to transfer across a long distance (FIG. 12).

In addition to selectively permitting either dogs 30 or 31 to move upwardly for transfer, the system can be operated also by moving the dogs upwardly simultaneously or sequentially as may be required.

For example, where it is desired to minimize the number of pushers on the conveyor, it might be desirable to cut away both flanges of the track at appropriate points to permit both dogs 30, 31 to be simultaneously moved upwardly. In this manner, the pusher 13 which is nearest to one of the dogs 30, 31 will move the carrier forwardly. Thus, the number of pushers on the conveyor chain can be minimized thereby reducing costs and still retaining a minimum lapse of time in transfer.

The dogs might also be operatively positioned sequentially such as in a situation wherein a long transfer is desired. The first dog 30 is permitted to move upwardly to permit a succeeding pusher 13 to move the carrier partway and then a second dog 31 is permitted to move upwardly to permit a succeeding pusher 13 to move the carrier a further distance. Such an arrangement might also be advantageous where it is desired to depress the first-mentioned dog 30 for clearance or other purposes.

We claim:

1. A carrier comprising a plurality of trolleys adapted to move along a track, means pivotally interconnecting said trolleys, a first pusher dog mounted on a foremost trolley, a second dog mounted on a succeeding trolley and movable to and from operative position for engagement by a pusher of a conveyor, a third dog mounted on a further succeeding trolley and movable to and from operative position for engagement by a pusher of a conveyor, and a projection on each of said second and third pusher dogs adapted to be engaged by portions of a track to hold said second and third dogs in inoperative position, the projection on said second pusher dog extending from one side only of said second pusher dog and the projection on said third pusher dog extending from the opposite side only of said third pusher dog such that one of said second and third pusher dogs can be permitted to move upwardly into operative position without permitting the other of said second and third pusher dogs to move upwardly.

2. In a conveyor system, the combination comprising means defining a first load supporting track portion, a first conveyor having a portion thereof adjacent said first track portion and including longitudinally spaced pusher members, a plurality of carriers for movement along said first track portion, each said carrier having a first pusher dog, each said carrier having second and third pusher dogs spaced longitudinally, each of said second and third pusher dogs being movable to and from operative position where it may be engaged by a pusher member on the first conveyor, each of said second and third pusher dogs being urged upwardly into operative position, said second and third dogs having oppositely extending projections, portions of said first track portion normally extending toward and overlying said projections of said second and third pusher dogs and to engage said projections and hold said second and third pusher dogs in inoperative position, a second load supporting track portion, first means for guiding said carrier between said first and second load supporting track portions, a second conveyor movable along said second track portion for engaging a dog of said carrier to move said carrier along said second track portion, portions of said first track portion in the area of said first guiding means extending toward said second pusher dog a lesser distance and thereby permitting said second dog only to move upwardly successively in position for engagement with a pusher member of said first conveyor whereby when a carrier is moved to said first guiding means, a pusher member on said first conveyor becomes disengaged from said first dog and a succeeding pusher member engages said second dog to push said carrier between said first and second load supporting track portion, while said third dog is held down, a third load supporting track portion, a fourth load supporting track portion, second means for guiding said carrier between one of said third and fourth load supporting track portions, a third conveyor movable along said third track portion for engaging a dog of said carrier to move said carrier along said third track portion, the distance between said first and second load supporting track portions being less than the distance between said third and fourth load supporting track portions, portions of said third track portion in the area of said second guiding means extending toward said third pusher dog a lesser distance and thereby permitting said third dog only to move upwardly successively in position for engagement with a pusher member of the third conveyor whereby when a carrier is moved to said second guiding means, a pusher member on said third conveyor becomes disengaged from said first dog and a succeeding pusher member on said third conveyor engages said third dog to push said carrier between said third and fourth load supporting track portions, while said second dog is held down.

3. The combination set forth in claim 2 including a fourth conveyor movable along said fourth track portion for engaging a dog of said carrier to move said carrier along said fourth track portion.

4. The combination set forth in claim 2 wherein said track portions comprise spaced channels having horizontally extending flanges, the flanges of said channels extending inwardly toward one another and normally overlying and engaging said projections of said second and third dogs to hold them in inoperative position.

5. The combination set forth in claim 2 wherein said carrier comprises a plurality of trolleys, said first pusher dog being on the foremost trolley, said second pusher dog being on a succeeding trolley, said third pusher dog being on a further succeeding trolley.

* * * * *